US006411220B1

(12) United States Patent
Davis et al.

(10) Patent No.: US 6,411,220 B1
(45) Date of Patent: Jun. 25, 2002

(54) TRAFFIC PAGING SYSTEM

(75) Inventors: Steven J. Davis, Hermosa Beach; Gordon E. Kaiser, San Juan Capistrano, both of CA (US)

(73) Assignee: Cue Corporation, Irvine, CA (US)

( * ) Notice: Subject to any disclaimer, the term of this patent is extended or adjusted under 35 U.S.C. 154(b) by 0 days.

(21) Appl. No.: 09/706,665

(22) Filed: Nov. 3, 2000

Related U.S. Application Data

(63) Continuation-in-part of application No. 09/690,617, filed on Oct. 16, 2000, and a continuation-in-part of application No. 09/455,614, filed on Dec. 7, 1999, now Pat. No. 6,232,888.

(51) Int. Cl.[7] ..... G08G 1/09

(52) U.S. Cl. ..... 340/905; 340/996

(58) Field of Search ..... 340/905, 988, 340/990, 992, 994, 995, 996, 989; 455/158.4, 186.1, 186.2, 45, 226.1; 701/200, 207, 208

(56) References Cited

U.S. PATENT DOCUMENTS

| | | | | |
|---|---|---|---|---|
| 4,006,447 A | | 2/1977 | Narbaits-Jaureguy et al. | 340/901 |
| 4,812,843 A | | 3/1989 | Champion, III et al. | 340/905 |
| 4,862,513 A | * | 8/1989 | Bragas | 340/905 |
| 4,887,308 A | | 12/1989 | Dutton | 455/156.1 |
| 5,095,532 A | * | 3/1992 | Mardus | 340/905 |
| 5,131,020 A | | 7/1992 | Liebesny et al. | 340/905 |
| 5,193,214 A | | 3/1993 | Mardus et al. | 340/905 |
| 5,239,700 A | * | 8/1993 | Guenther et al. | 455/158.4 |
| 5,438,687 A | * | 8/1995 | Suchowerskyj et al. | 340/905 |
| 5,493,709 A | * | 2/1996 | Duckeck et al. | 455/185.1 |
| 5,572,201 A | | 11/1996 | Graham et al. | 340/902 |
| 5,719,771 A | | 2/1998 | Buck et al. | 340/988 |
| 5,774,827 A | | 6/1998 | Smith, Jr. et al. | 701/209 |
| 5,808,566 A | | 9/1998 | Behr et al. | 340/995 |
| 5,835,026 A | | 11/1998 | Wicks et al. | 340/905 |
| 5,848,373 A | | 12/1998 | DeLorme et al. | 340/995 |
| 5,850,190 A | | 12/1998 | Wicks et al. | 340/905 |
| 5,864,305 A | | 1/1999 | Rosenquist | 340/905 |
| 5,884,216 A | | 3/1999 | Shah et al. | 701/207 |

* cited by examiner

*Primary Examiner*—Van Trieu
(74) *Attorney, Agent, or Firm*—Lyon & Lyon LLP

(57) ABSTRACT

A traffic paging system for audibly disseminating real-time traffic information and methods of manufacturing and using the same. The traffic paging system comprises a route-entry system, a receiver system, and an audio system. The route-entry system permits a user to specify one or more preselected routes. After receiving the real-time traffic information, the receiver system converts a relevant portion of the real-time traffic information that is specific to the preselected routes into audio traffic information. The audio system then audibly presents the audio traffic information to the user.

20 Claims, 7 Drawing Sheets

TRAFFIC PAGING SYSTEM

CROSS-REFERENCE TO RELATED APPLICATIONS

This application is a continuation-in-part of U.S. patent application Ser. No. 09/455,614, filed on Dec. 7, 1999, now U.S. Pat. No. 6,232,888, and of co-pending U.S. patent application Ser. No. 09/690,617, filed on Oct. 16, 2000. The priority of these prior applications is expressly claimed and their disclosures are hereby incorporated by reference in their entirety.

BACKGROUND OF THE INVENTION

1. Field of the Invention

The present invention relates generally to wireless messaging systems and, more particularly, to a wireless messaging system providing audible real-time, route-specific information, including weather as well as actual and potential traffic conditions.

2. Background of the Invention

Traffic congestion has become a commuter's biggest headache. As society has grown more mobile, the number of vehicles clogging our roads has dramatically increased, resulting in longer commute times and frustrated commuters. This congestion has many causes, including traffic hazards, vehicle accidents, road construction and maintenance, and volumes of traffic that overwhelm the capacity of the highway system.

Due to the continuing severity of this problem, many commuters take precautions before and during their commutes to avoid this congestion. For example, many commuters listen to television stations or access Internet sites that provide local traffic and weather information. Armed with this information, these commuters hope to avoid any unnecessary delays on the highway. Since traffic and weather conditions are changing constantly, however, the information that the commuters receive from these sources may quickly become inaccurate during their commute. To keep drivers current on dynamic highway conditions, commercial radio stations also broadcast traffic and weather information to assist commuters as they drive. But, although these radio stations provide frequent updates, this information is provided only at limited intervals. Further, each update encompasses only small portions of a larger geographic area.

Commuters may also be kept informed of changing traffic and weather conditions through the use of mobile traffic pagers that provide route-specific information. For example, U.S. Pat. No. 5,850,190, issued to Wicks, the disclosure of which is incorporated herein by reference, describes a traffic information pager for receiving and visually displaying traffic information through the use of icons on a map. The traffic information pager under this patent compares incoming traffic information with a preselected route and displays any relevant information with the icons indicating the location, type, and severity of an actual or potential traffic problem. Similarly, U.S. Pat. No. 5,835,026, also issued to Wicks, the disclosure of which is incorporated herein by reference, describes a commuter information pager that visually displays incoming traffic reports.

In operation, a service provider for a paging system compiles information regarding the weather and actual or potential traffic problems from commercial sources or by scanning the emergency service frequencies. Commuters who subscribe to the paging system each provide the service provider with a description of one or more preselected routes and, in return, receive a mobile traffic pager with a display. When traffic or weather information arrives, the service provider will compare the information with a database of commuter preselected routes and transmit the information to the mobile traffic pager of each affected subscribing commuter. Each mobile traffic pager visually presents the information on the display. After being notified of the actual or potential problem, each subscribing commuter may alter his preselected route to avoid any congestion that may result from the traffic or weather conditions.

The use of mobile traffic pagers, however, currently suffers from a critical disadvantage. When traffic or weather information arrives, the mobile traffic pager displays the information visually, requiring the driver to divert his attention from the road and the surrounding traffic. The commuter then must refocus on the mobile traffic pager and examine the display to determine which information is new as well as the location, type, and severity of the problem.

In view of the foregoing, a need exists for an enhanced audible traffic information and paging system that overcomes the aforementioned obstacles and deficiencies of currently available mobile traffic pagers.

SUMMARY OF THE INVENTION

The present invention is directed to a wireless messaging system providing audible realtime, route-specific information, including traffic and weather conditions. Through the use of the present invention, a commuter can receive information regarding changing weather conditions as well as actual or potential traffic problems along his preselected route and avoid any resulting traffic congestion. The present invention thereby provides the advantage of presenting the commuter with real-time, route-specific information without requiring the commuter to divert his attention from the road and the surrounding traffic.

A traffic paging system in accordance with the present invention may comprise a route-entry system, a receiver system, an audio system, a transmit encoder system, an automated traffic incident-to-audio message assembly, and a paging terminal. The route-entry system preferably allows a commuter to specify at least one preselected route. The receiver system may be coupled with the route-entry system and may receive real-time traffic or weather information. The receiver system preferably selects relevant real-time information from a set of information broadcast by the transmit encoder system that is specific to one or more of the preselected routes and converts the relevant portion of the real-time information into sound information. The audio system, which is coupled with the receiver system, audibly presents the transmit encoder information to the driver.

It will be appreciated that a traffic paging system in accordance with the present invention may serve to alleviate a primary safety concern regarding the use of current mobile traffic pagers. As presently used, mobile traffic pagers visually provide traffic and weather information using built-in displays. The commuter, as a result, must examine the traffic pager and its display to discover the information, distracting the commuter's attention from the road and the surrounding traffic. In contrast, traffic paging systems of the present invention include an audio system that permits the commuter to learn new traffic and weather information without being distracted from the road. Thereby, commuters can more safely receive real-time information that is relevant to their preselected routes.

DETAILED DESCRIPTION OF THE PREFERRED EMBODIMENTS

Figure 1:
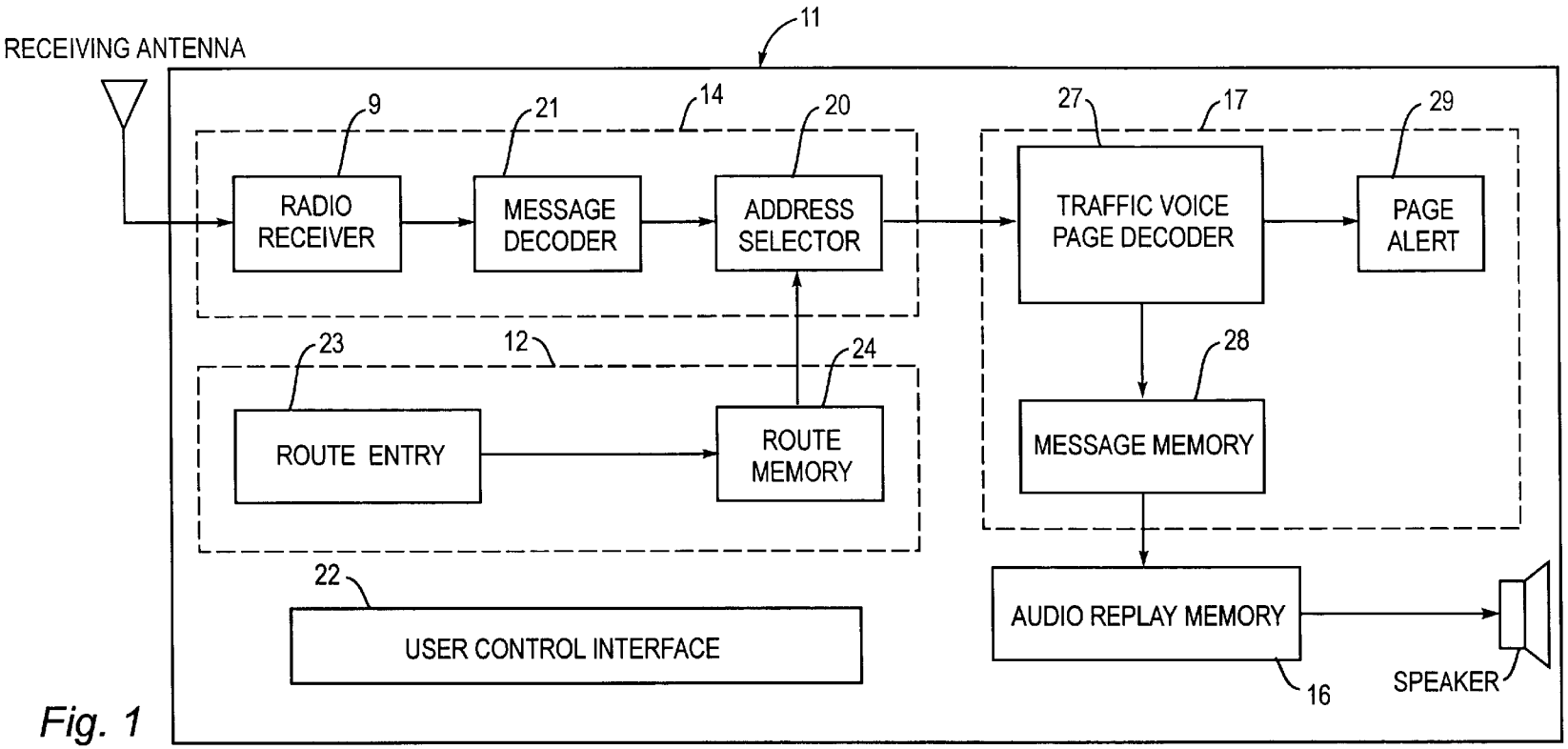
FIG. 1 is an illustration of one preferred embodiment of a traffic paging system in accordance with the present invention.
Figure 8:
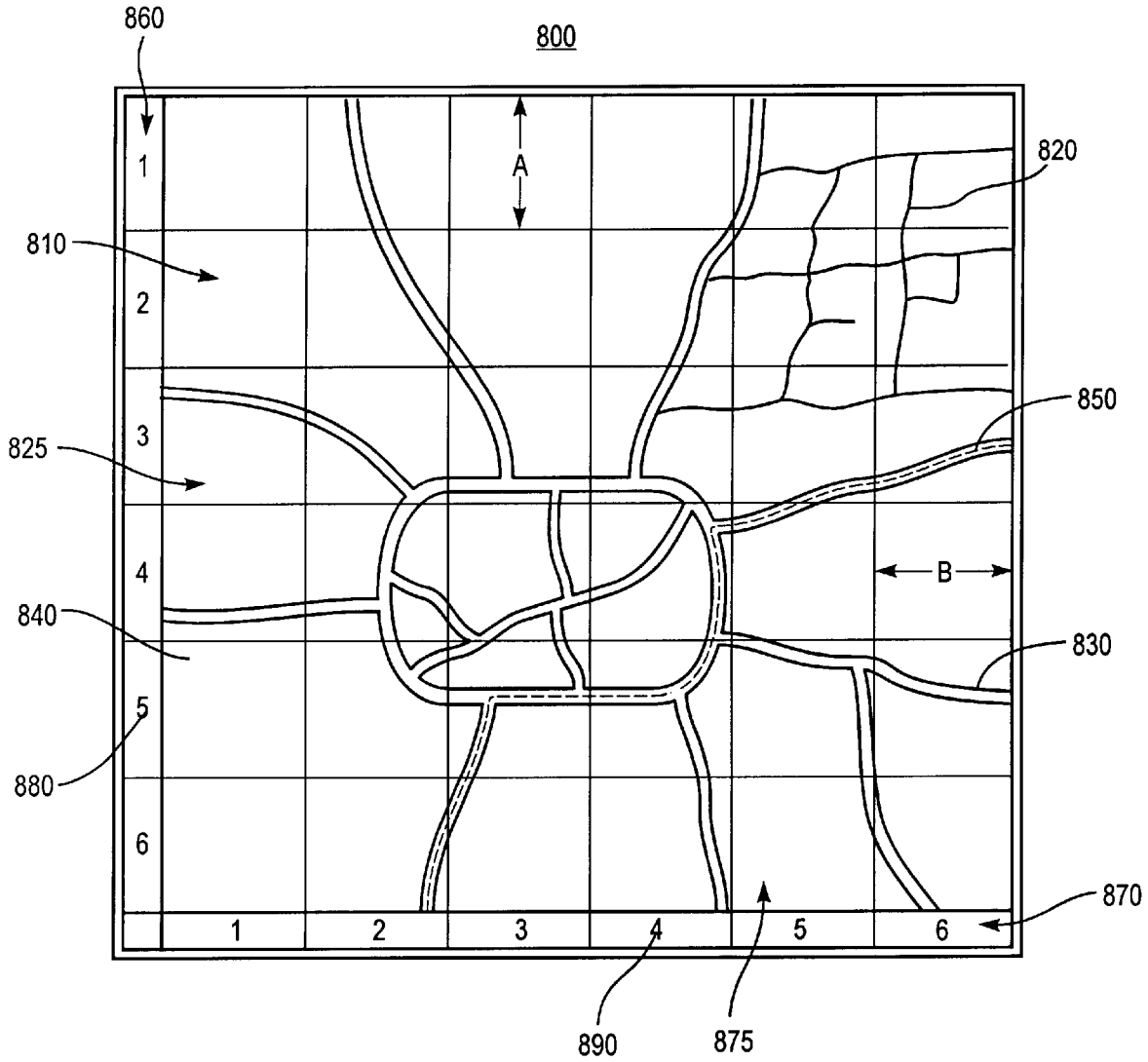
FIG. 8 is an illustration of a map divided into a plurality of traffic zones in accordance with the present invention.

Since diverting a commuter's attention from the road and surrounding traffic presents a serious safety concern, the commuter is audibly presented with real-time information regarding weather and traffic conditions. This result may be achieved, according to one embodiment of the present invention, by employing a traffic paging system 10 as shown in FIG. 1. The traffic paging system 10 may comprise a pager, a personal digital assistant, a cellular telephone, a car radio, and/or any other type of communication device and includes a traffic voice pager 11 having a route-entry system 12, a receiver system 14, an audio replay system 16, and traffic voice page decoding system 17. The route-entry system 12 provides the commuter with the ability to specify one or more preselected routes 850 and comprises a map 800 divided into a plurality of traffic zones 840, as shown in FIG. 8. The commuter may specify the preselected routes 850, which comprise any route that the commuter may take to any destination, including work, school, or elsewhere, by selecting one or more of the traffic zones 840. The route-entry system 12 associates each traffic zone 840 with a unique pager address.

Returning to FIG. 1, the receiver system 14 is coupled with the route-entry system 12 and includes a radio receiver 9, an address selector 20, and a message decoder 21. The radio receiver 9 receives one or more coded traffic voice pages. Each coded traffic voice pages comprises information such as an alpha/numeric pages, voice pages, and/or weather or traffic conditions, including potential or actual traffic problems. For example, each coded traffic voice page can include a description of a type, a location, a duration, an extent, a directional flow effected, and/or a severity of the weather or traffic condition. The types of conditions include traffic accidents and road closures, and the location comprises a geographic area where the reported condition occurred, including, for example, an intersection, a mile marker and/or a ramp on a freeway, and/or a geographic name, such as "The Grapevine." The duration of the condition may include the total time needed to correct the condition and/or the remaining time to correct the condition. The extent of the condition basically comprises a geographic area that is being effected by the condition at a particular time and/or over a period of time.

After receiving one or more coded traffic voice pages, the radio receiver 9 communicates each coded traffic voice page to the message decoder 21, which is coupled with the radio receiver 9. The message decoder 21 then decodes data/network codes and pager addresses that are associated with the coded traffic voice pages. The message decoder 21 communicates the decoded data/network codes and pager addresses to the first address selector 20. The first address selector 20 is coupled with, and capable of communicating with the message decoder 21 and compares the location of the weather or traffic condition with each of the preselected routes 850. If the location of the weather or traffic condition corresponds to one or more of the preselected routes 850, a relevant portion 25 of the real-time information 24 is generated, and the converter 22, which is coupled with the first address selector 20, converts the relevant,portion 25 into audio information 26. The audio system 16 is coupled with the converter 22 and receives the audio information 26. The audio system 16 then audibly presents the audio information 26 to the commuter.

In use, the commuter enters a preselected commuter route 850 into the traffic paging system 10 with the route-entry system 12. As shown in FIG. 8, the route-entry system includes at least one map 800. Each map 800 comprises a graphic representation of a geographic region 810, having one or more surface streets 820 and/or one or more freeways 830 traversing the geographic region 810. Each geographic region 810 may comprise a city, a county, a state, and/or any other type of larger or smaller geographic region 800, including a portion of the city, the county, and/or the state. Stated somewhat differently, the city, the county, the state, and/or the other type of geographic region 800 can be represented by one or more maps 800.

Figure 5:
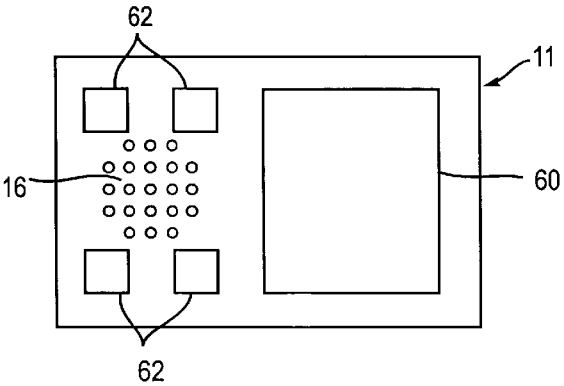
FIG. 5 is a detailed view of a traffic pager of a traffic paging system in accordance with the present invention.

Each map 800 is divided into a plurality of traffic zones 840, and the commuter enters each preselected commuter route 850 by selecting one or more of the traffic zones 840 via, for example, one or more switches 62 provided by the route-entry system 12 of the traffic voice pager 11, as shown in FIG. 5. As the number of traffic zones 840 provided in each map 800 increases, the resolution by which each preselected commuter route 850 may be specified also increases, permitting the audible presentation of audio information 26 that is more directed to each preselected commuter route 850. Conversely, providing a smaller number of traffic zones 840 in each map 800 results in the audible presentation of more audio information 26 that may be irrelevant to each preselected commuter route 850. For example, if each map 800 of a geographic region comprises a single traffic zone 840, the traffic information audio information 26 for the entire geographic region would be audibly presented.

The plurality of traffic zones 840 preferably are formed by dividing each map 800 into a plurality of rows 860 and a plurality of columns 870 as shown in FIG. 8. The plurality of rows 860 subdivide the map 800 horizontally. A horizontal segment 825 of the map 800 is included in each of the plurality of rows 860 and has a width A. Similarly, the plurality of columns 870 subdivide the map 800 vertically. Each of the plurality of columns 870 comprises a vertical segment 875 of the map 800, each vertical segment 875 having a width B. The width A of the plurality of rows 860 may be, but are not required to be, substantially equal to the width B of the plurality of columns 870. The width A of the plurality of rows 860 can be substantially uniform, and the width B of the plurality of columns 870 can be substantially uniform. The number of rows 860 may be greater than, equal to, or less than the number of columns 870 for each map 800.

Once at least one map 800 has been provided, one or more preselected commuter routes 850 are entered via the one or more switches 62 of the route-entry system 12. The plurality of rows 860 each are assigned a unique row designator 880, and each of the plurality of columns 870 is assigned a unique column designator 890. The row designators 880 and the column designators 890 each comprise any type of designator such as one or more numbers and/or letters and are associated with the switches 62 of the route-entry system 12 such that one of the plurality of rows 860 and/or one of the plurality of columns 870 is selected by activating one of the switches 62. Thereby, to enter the preselected commuter route 850, the switch 62 associated with the relevant row 860 and the switch 62 associated with the relevant column 870 each are activated for each of the plurality of traffic zones 840 comprising the preselected commuter route 850. The switch 62 associated with the relevant row 860 may be activated before, after, or simultaneously with the switch 62 associated with the relevant column 870. A predetermined period of time can be permitted between the activation of the switch 62 associated with the relevant row 860 and the switch 62 associated with the relevant column 870 after which the route-entry system 12 may time out and/or provide a warning, or an indefinite period of time may be provided to enter the preselected commuter routes 850. Each traffic zone 840 in the preselected commuter route 850 is identified by the relevant row 860 and the relevant column 870 before a next traffic zone 840 is identified. The preselected commuter routes 850 may be entered and/or revised before and/or during the commute.

Figure 9:
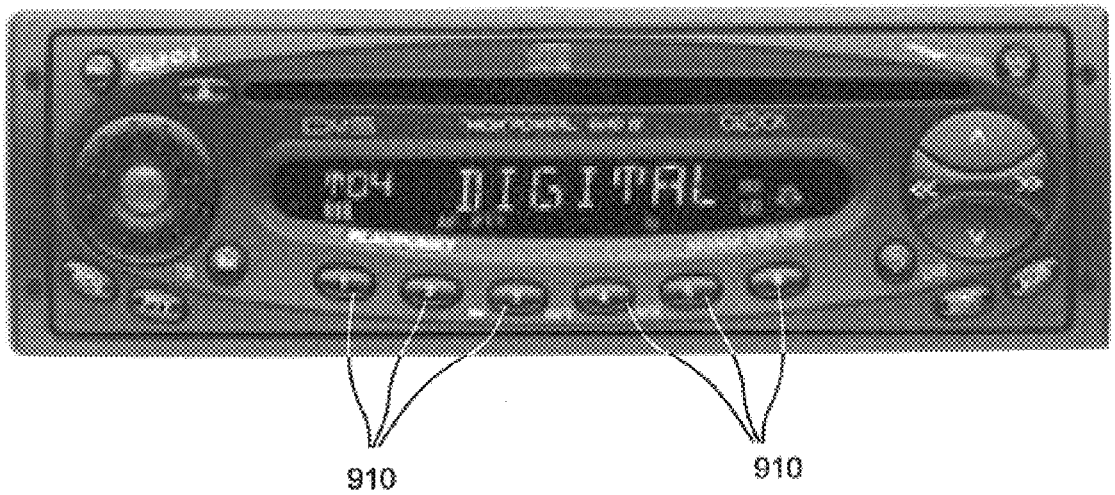
FIG. 9 is an illustration of the traffic paging system comprising a car radio in accordance with the present invention.

To illustrate the use of the one or more switches 62 of the route-entry system 12, the traffic voice pager 11 can comprises a car radio 900 with a predetermined number of station preset buttons 910, as shown in FIG. 9. The preselected commuter routes 850 can be entered via the predetermined number of station preset buttons 910 of the car radio 900. The car radio 900 is coupled with the receiver system 14 via, for example, a cellular telephone interface (not shown) of the car radio 900. The receiver system 14 includes a route memory 24 for storing each of the preselected routes 850 and an address selector 20 for comparing the location of the weather or traffic condition with the preselected routes 850 in the route memory 24. The route memory 24 is coupled with the address selector 20 and is coupled with the predetermined number of station preset buttons 910 via the cellular telephone interface. The plurality of rows 860 and the plurality of columns 870 for each map 800 each preferably are substantially equal to the predetermined number of station preset buttons 910. Thereby, each traffic zone 840 along each preselected commuter route 850 is selected by activating a sequence of the station preset buttons 910, one station preset button 910 for the row designator 880 and one station preset button 910 for the column designator 890 associated for each traffic zone 840 comprising the preselected route 850. For example, if located in the third row 860 and the second column 870 of a map 800, the desired traffic zone 840 is entered by activating the third station preset button 910 and then the second station preset button 910 on the car radio 900. As before, it alternatively may be possible to enter the desired traffic zone 840 by activating the station preset button 910 associated with the column designator 890 before, after, and/or simultaneously with the station preset button 910 associated with the row designator 880.

Since the typical car radio 900, such as, for example, Blaupunkt's Nevada series car radio, includes six station preset buttons 910, each map 800 preferably is divided into six rows 860 and six columns 870 to provide the maximum resolution for entering the preselected commuter routes 850. When using such maps 800 with car radios 900 having seven or more station preset buttons 910, the station preset buttons 910 in excess of six are ignored for purposes of entering preselected commuter routes 850. Conversely, car radios 900 having five or fewer station preset buttons 910 will be unable to enter preselected commuter routes 850 comprising certain traffic zones on such maps 800. As a result, multiple maps each with a different number of rows 860 and columns 870 may be provided for each geographic region 810 to accommodate car radios 900 with different numbers of station preset buttons 910.

During the commute, the commuter may use the traffic voice pager 11 to monitor traffic and/or weather conditions. The first receiver 18 of the receiving system 14 receives real-time information 24 regarding, for example, a traffic accident along one or more of the preselected commuter routes 850. The first address selector 20 compares the location of the traffic accident to the preselected commuter route 850, and, since the traffic accident corresponds to the preselected commuter route 850, the real-time information 24 is included within the relevant portion 25. The relevant portion 25 then is converted to audio information 26 by the converter 22 and audibly presented by the audio system 16. If, on the other hand, the traffic accident does not correspond to the preselected route, the first address selector 20 would not include. the realtime information 24 within the relevant portion 25, and the commuter would not be audibly notified of the traffic accident.

Figure 2:
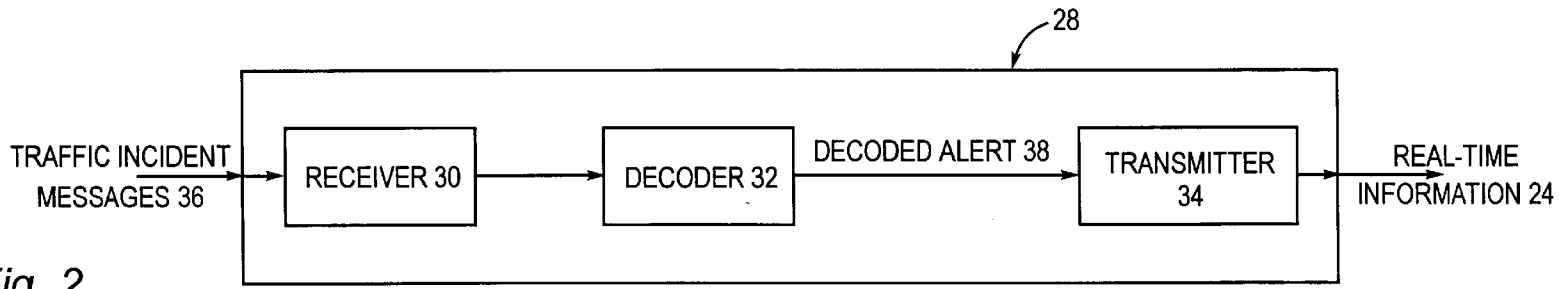
FIG. 2 is an illustration of a second preferred embodiment of a traffic paging system in accordance with the present invention.

In a second embodiment, the traffic paging system 10 further has an internmediate transmitter system 28, as shown in FIG. 2. The intermediate transmitter system 28 includes a second receiver 30, a decoder 32, and a transmitter 34. The second receiver 30 receives one or more encoded alerts 36 from, for example, an external source, such as a commercial traffic information provider, a news broadcast, or a report over an emergency service radio frequency. Alternatively, an operator of a traffic paging service may generate its own traffic information by, for example, chartering one or more helicopters or airplanes to fly over preselected areas and to provide information regarding the preselected areas. Like the real-time information 24, each of the encoded alerts 36 includes real-time information regarding, for example, a weather or traffic condition, including potential or actual traffic problems. The one or more encoded alerts 36 include a description of a type, a location, a duration, an extent, a direction of flow effected and/or a severity of the weather or traffic condition.

The one or more encoded alerts 36 may be encoded under, for example, the Data Radio Channel (DARC) System standard, the Radio Data System Traffic Message Channel (RDS-TMC) standard, or any other radio standard. The decoder 32 is coupled with the second receiver 30 and extracts a decoded alert 38 from each of the one or more encoded alerts 36. Each decoded alert 38 preferably includes a textual description (not shown) of each respective encoded alert 1036. Afterward, each decoded alert 38 is broadcast as real-time information 24 by the transmitter 34, which is coupled with the decoder 32, and then received by the first receiver 18 of the traffic voice pager 11.

Figure 3:
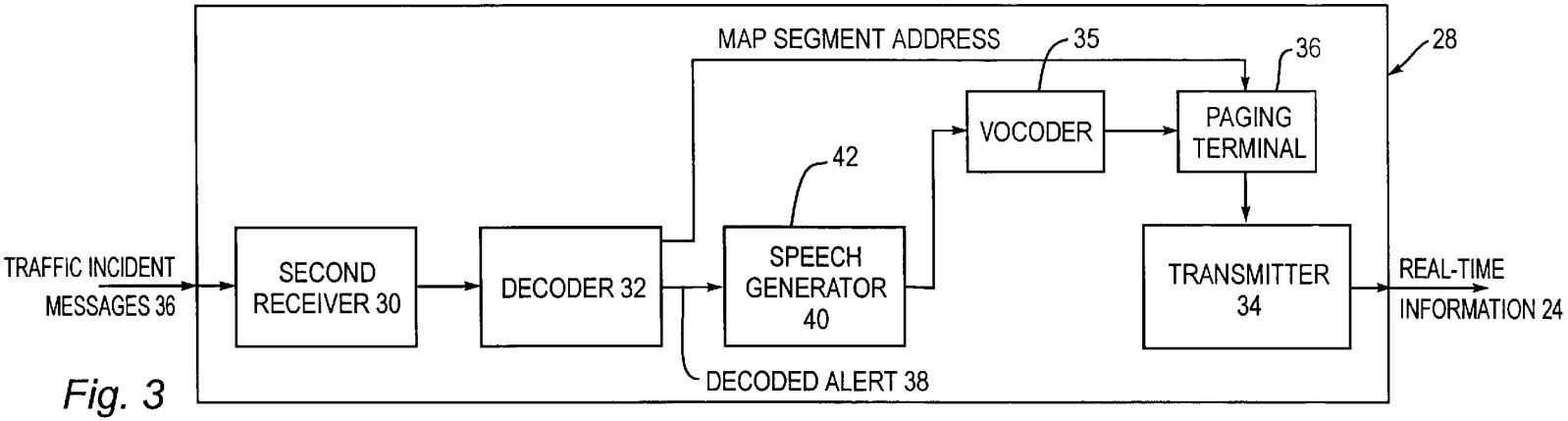
FIG. 3 is an illustration of an alternative construction of the traffic paging system shown in FIG. 2.

The intermediate transmitter system 28 of the traffic paging system 10 further includes a speech generator 40 for converting each decoded alert 38 into speech information 42. The speech information 42 then is converted into compressed speech by a vocoder 35 and passed to a paging terminal 36 to create a properly addressed traffic voice page. The address is desired by paging terminal 36 from decoded traffic incident location data by decoder 32 as shown in FIG. 3. Alternatively, the speech generator 38 may be provided in the converter 22 of the traffic voice pager 11 where, in one embodiment, textual traffic incident reports are converted to synthetic speech by methods well-known to those knowledgeable in the art. Within the intermediate transmitter system 28, the speech generator 40 is disposed between, and coupled with, the decoder 32 and the transmitter 34 and permits each decoded alert 38 to pass through to the transmitter 34. For each decoded alert 38, the real-time information 24 substantially comprises the decoded alert 38 and the speech information 42 generated from the decoded alert 38.

The speech generator 40 can comprise, for example, a speech synthesizer (not shown). An input of the speech synthesizer is coupled with the decoder 32 and receives each decoded alert 38. The speech synthesizer converts the textual description within each decoded alert 38 into the speech information 42, and an output of the speech synthesizer is coupled with the transsnsmitter 34 and provides the speech information 42 to the transmitter 34.

Figure 4:
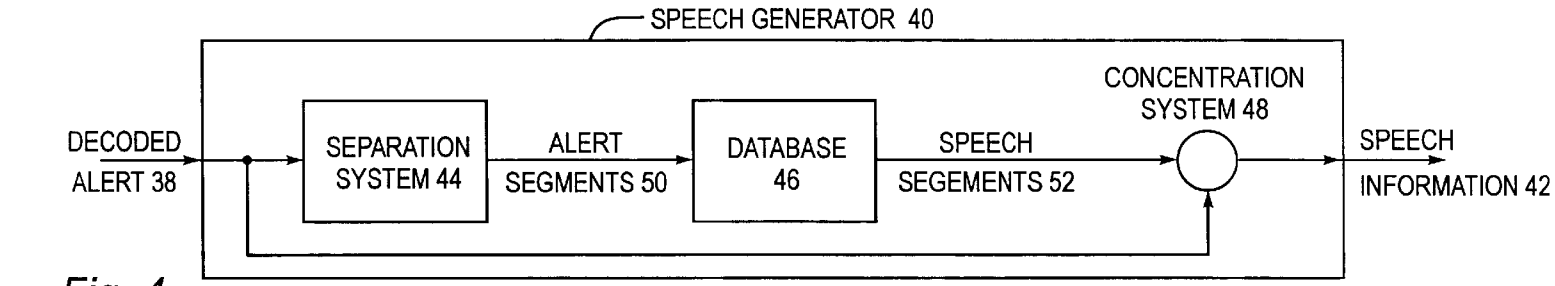
FIG. 4 is an illustration of a detailed view of the traffic paging system shown in FIG. 3.

Alternatively, the speech generator 40 may comprise a separation system 44, a database 46, and a concatenation system 48, as shown in FIG. 4. The separation system is coupled with the decoder 32 and separates each decoded alert 38 into a sequence of one or more pre-recorded traffic message voice segments 50, each comprising a phrase of one or more words. The database 46 is coupled with the separation system 44 and receives the one or more alert segments 50 from the separation system 44. The database 46 preferably substantially comprises a plurality of prerecorded speech files (not shown). Each prerecorded speech file substantially comprises the spoken words of the associated phrase and may be stored in any file format, including waveform sound or audio (.WAV), compressed waveform sound or audio, MIDI sound or audio (.MID), .MP3, and/or any other type of sound or audio format. Each prerecorded speech file comprises words spoken with a human voice and includes a description of a type, a location, a duration, an extent, a directional flow effected or a severity of the weather or traffic condition. To assure continuity of speech, each prerecorded speech file provides a complete description of, for example, a location of the condition instead of storing individual words or phrases such as street names. For example, a prerecorded speech file providing the description of the location of a traffic condition could be "the intersection of Main Street and MacArthur Boulevard" rather than concatenating the series of individual prerecorded speech files "intersection of," "Main Street," "and," and "MacArthur Boulevard." After receiving one of the phrases, the database 46 produces a speech segment 52 that substantially comprises the prerecorded speech file associated with the phrase. Therefore, when the database 46 receives the sequence of one or more alert segments 50, the database 46 responds with a sequence of one or more speech segments 52. The concatenation system 48 is coupled with the database 46 and receives the sequence of one or more speech segments 52 from the database 46. The concatenation system 48 concatenates the sequence of one or more speech segments 52, in order, onto the decoded alert 38, substantially reproducing the textual description of the decoded alert 38 in speech.

As shown in FIG. 5, the traffic paging system 10 further includes a storage system 54 for storing stored information 59 and is capable of audibly presenting the stored information 59. The stored information 59 comprises an accumulation of information from at least one. prior relevant portion (not shown) from earlier real-time information broadcasts. The storage system 54 comprises a second address selector 56 and a memory system 58. The second address selector 56 is coupled with the first address selector 20, and the memory system 58 is coupled with the second address selector 56. The second address selector 56 and the memory system 58 each is coupled with the converter 22.

In operation, each time the traffic paging system 10 receives real-time information 24, the second address selector 56 compares the relevant portion 25 of the real-time information 24 to the stored information 59 within the memory system 58. If the relevant portion 25 does not appear within the stored information 59, the relevant portion 25 substantially comprises a new alert (not shown). In such a case, the new alert is stored in the stored information 59, and the audio system 16 audibly presents the new alert. A prior alert (not shown) in the stored information 59 may be revised before being audibly presented by the audio system 16 when the relevant portion 25 is comprised of an update to the prior alert. The update may include, for example, a cancellation or a change in the location, type, and/or severity of a weather or traffic condition. If the prior alert has not been updated or cancelled within a preselected time interval, the prior alert can be deleted from the stored information, and the cancellation of the prior alert may be audibly presented.

Figure 6:
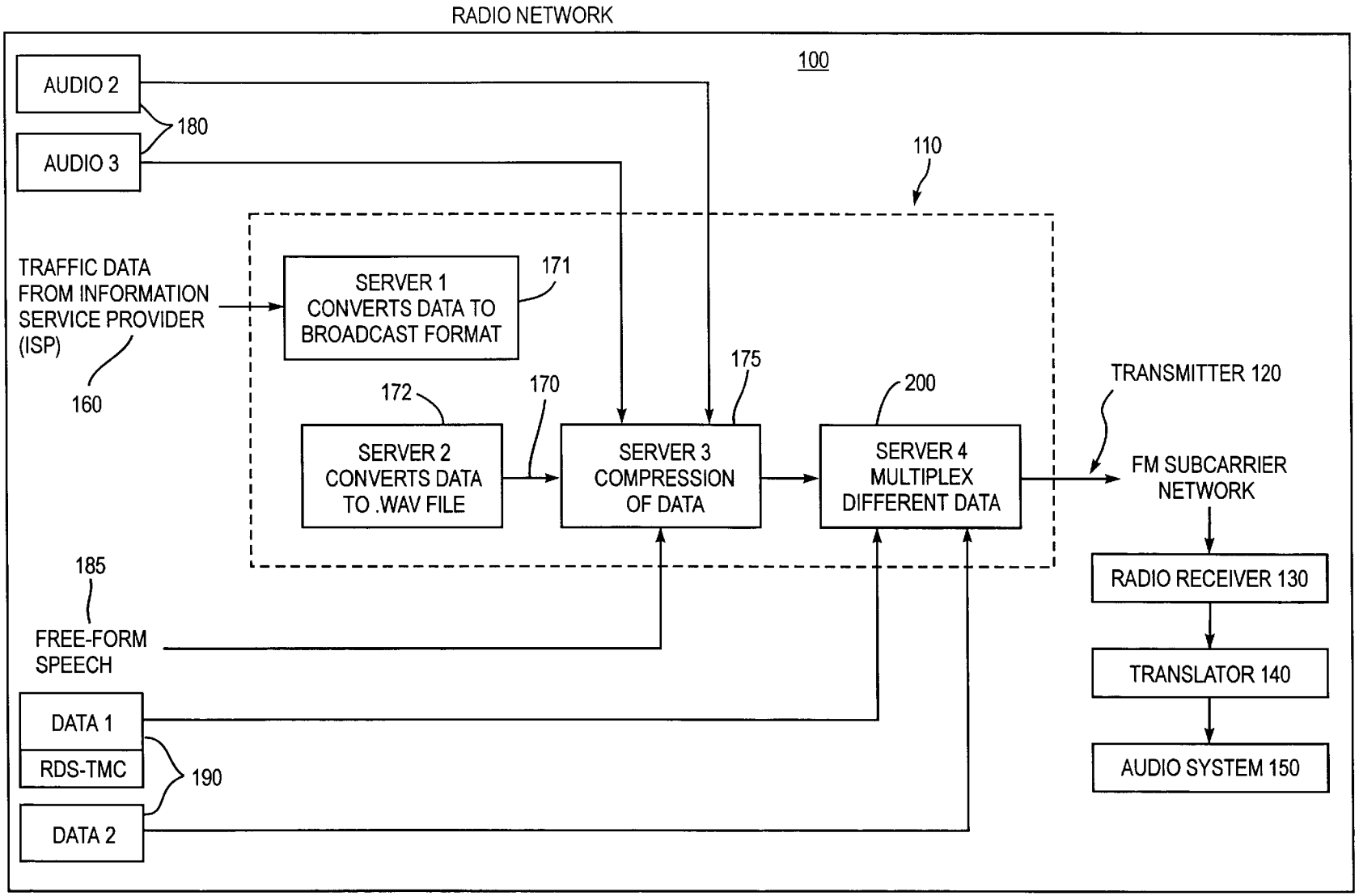
FIG. 6 is an illustration of a fourth preferred embodiment of a traffic paging system in accordance with the present invention.

The traffic voice pager 11 preferably is mobile, as shown in FIG. 6. The traffic voice pager 11 may be handheld or mounted in a vehicle (not shown) such as a car, truck, or any other type of vehicle. The route-entry system 12 of the traffic voice pager 11 includes one or more switches 62. The one or more switches 62 may comprise one or more separate pushbuttons, a keypad, or any other type of electrical or mechanical switch. The route-entry system 12 further includes a storage media 64 (as shown in FIG. 1) for storing and/or recalling the preselected routes 850. The storage media 64 stores and/or recalls the preselected routes 850 entered by the commuter and/or preprogrammed routes to one or more preprogrammed destination, such as an airport, a ballpark, a shopping center and/or another city. The audio system 16 may comprise a electromagnetic speaker, a piezoelectric speaker, or any other type of speaker or audio device. The traffic voice pager 11 may further include a display 60 for visually presenting the relevant portion 25 of the real-time information 24. The display 60 visually presents the characteristics the relevant portion 25 with text and/or with at least one icon (not shown). For example, the display 60 may indicate the nature, location, and severity of the relevant portion 25 of the realtime information.

Figure 10A:
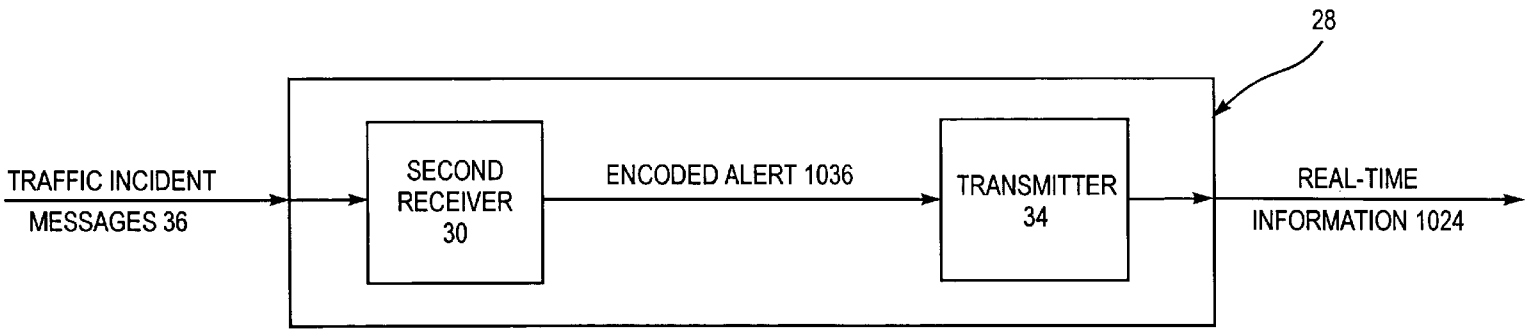
FIGS. 10A and 10B are an illustration of a third preferred embodiment of a traffic paging system in accordance with the present invention.
Figure 10B:
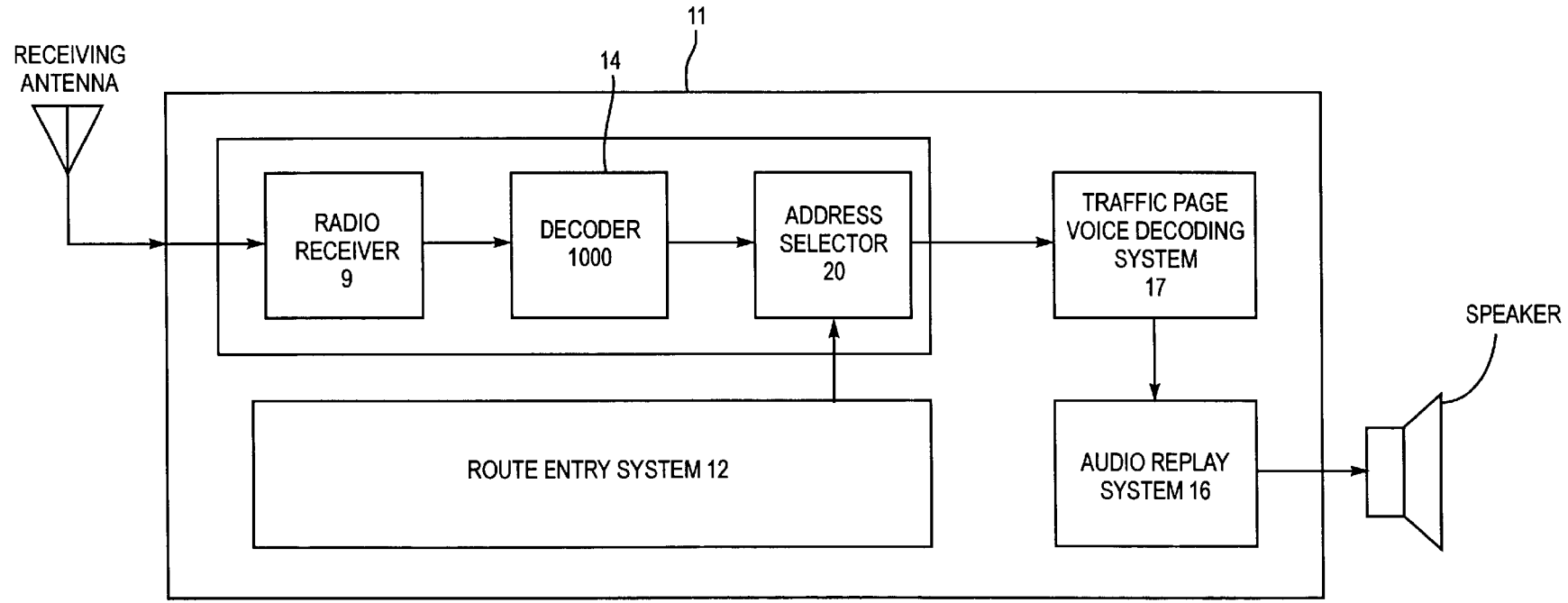

Alternatively, the decoder 32, disposed in the intermediate transmitter system 28 in the second preferred embodiment, may be located in the traffic voice pager 11 as the decoder 1000 in a third preferred embodiment of the present invention as shown in FIGS. 10A and 10B. By storing the decoder 1000 in the traffic voice pager 11, a lower speed and/or bandwidth network may be employed to transmit the encoded alerts 36 as real-time information 1024 in a format such as MBS or RDS/TMC. The encoded alerts 36 may be transmitted over broadcast bands such as analog AM or FM, AM or FM digital audio, digital audio over a satellite, IBOC (Independent Broadcast on Carrier), and/or any other type of broadcast band, including a hybrid of the aforementioned. Although the costs associated with the traffic voice pager 11 may be increased by adding the decoder 1000 to the traffic voice pager 11, this cost increase is overshadowed by the savings resulting by avoiding the expense associated with the development of a new communication network.

As shown in FIG. 10A, the intermediate transmitter system 28 comprises a second receiver 30 and a transmitter 34. The transmitter 34 is coupled with, and capable of communicating with, the second receiver 30. As before, the second receiver 30 is adapted to receive one or more traffic incident messages 36 from, for example, an external source, such as a commercial traffic information provider, a news broadcast, or a report over an emergency service radio frequency. The traffic incident messages 36 include a description of one or more attributes of the weather or traffic condition, such as a type, a location, a duration, an extent, a direction of flow effected and/or a severity. The traffic incident messages 36 may be encoded as one or more encoded alerts 1036 under, for example, the Data Radio Channel (DARC) System standard, the Radio Data System Traffic Message Channel (RDS-TMC) standard, or any other radio standard. Under the selected radio standard, each attribute includes a plurality of textual entries, each being associated with a predetermined code. For example, the type of traffic condition may include textual entries such as accident, road hazard, and road closure, and the textual entry "accident" can be associated with the predetermined code "10;" the textual entry "road hazard," with the predetermined code "11;" and the textual entry "road closure," with the predetermined code "12." The encoded alerts 1036 each comprise the predetermined codes for the one or more attributes relevant to the reported traffic condition. Upon receiving the encoded alerts 1036 from the second receiver 30, the encoded alerts 1036 are broadcast by the transmitter 34 as real-time information 1024 and then received by the first receiver 18 of the traffic voice pager 11 as shown in FIG. 10B.

The traffic voice pager 11 includes a receiver system 14, a route-entry system 12, an audio replay system 16, and a traffic voice page decoding system 17. The receiver system is comprises a radio receiver 9, a decoder 1000, and an address selector 20. The decoder 1000 is coupled with, and capable of communicating with, both the radio receiver 9 and the address selector 20, substantially replacing the message decoder 21 as shown in FIG. 1. The radio receiver 9 and the address selector 20 of the receiver system 14 are: arranged and operate as described above. As a result, the following discussion will primarily focus on the structure and operation of the decoder 1000, which substantially mirrors of the discussion of the message decoder 21 above. Since the traffic voice pager 11 is located in a mobile environment, however, other considerations, such as weight and space, must be considered with regard to the decoder 1000.

Returning to FIG. 10B, the radio receiver 9 receives the encoded alerts 1036 as real-time information 1024 from the transmitter 34 via a receiving antenna and communicates the encoded alerts 1036 to the decoder 1000. The decoder 1000 then decodes the encoded alerts 1036, producing decoded alerts 38. Continuing with the above decoding example, if one of the encoded alerts 1036 includes the predetermined code "11," the decoder 1000 converts the predetermined code "11" into the textual entry "road hazard" in the decoded alert 38. The textual entry includes audible speech information such as a prerecorded electronic audio or sound file. The prerecorded electronic audio or sound file substantially comprises an audible, spoken version of the textual entry.

The decoder 1000 preferably stores the plurality of textual entries and the predetermined codes for each attribute in a table. Upon receiving the predetermined code for an attribute in an encoded alert 1036, the table is capable of responding with the textual entry relevant to the predetermined code. The plurality of textual entries each include one or more prerecorded speech files. Each prerecorded speech file substantially comprises the spoken words of the associated phrase and may be stored in any file format, including waveform sound or audio (.WAV), compressed waveform sound or audio, MIDI sound or audio (.MID), or .MP3. Since the decoder is located in the mobile traffic voice pager 11, compressed waveform sound or audio files preferably are used to reduce the size of the prerecorded speech files. Each prerecorded speech file comprises words spoken with a human voice.

To store the plurality of textual entries, including more prerecorded speech files, and the predetermined codes for each attribute, the decoder 1000 includes a memory system (not shown), which can comprise any form of volatile memory such as SRAM and/or any form of non-volatile storage medium such as ROM, PROM, EPROM, FLASH, magnetic tape, CD ROM, DVD, and/or hard disk. For example, if the traffic voice pager 11 comprises a handheld unit, the memory system is stored in the traffic voice pager 11 and includes ROM and/or FLASH because the handheld unit should have a small size and a light weight. The memory system can comprise one or more CDs or DVDs for larger units, such as car radios, with the CD drive or the DVD drive being located in the truck of the car. Similar to the storage system 54 described above, the memory system also may be capable of storing stored information 59. The stored information 59 comprises an accumulation of information from at least one prior relevant portion (not shown) from earlier real-time information broadcasts and may be audibly presented by the audio replay system 16.

Since the capacity of the memory system is less expansive, the plurality of textual entries, including more prerecorded speech files, and/or the predetermined codes may need to be updated under certain circumstances. For example, if the traffic voice pager 11 is to be used in a different geographic area, the plurality of textual entries and/or the predetermined codes associated with the location attribute will need to be updated to reflect the streets and freeways in the different geographic area. Alternatively, the location attributes may need to be updated as additional roads are constructed. The update may be performed by providing the traffic voice pager 11 with one or more replacement CDs or DVDs and/or by updating the contents of the ROM and/or FLASH via, for example, Bluetooth wireless technology.

Figure 7A:
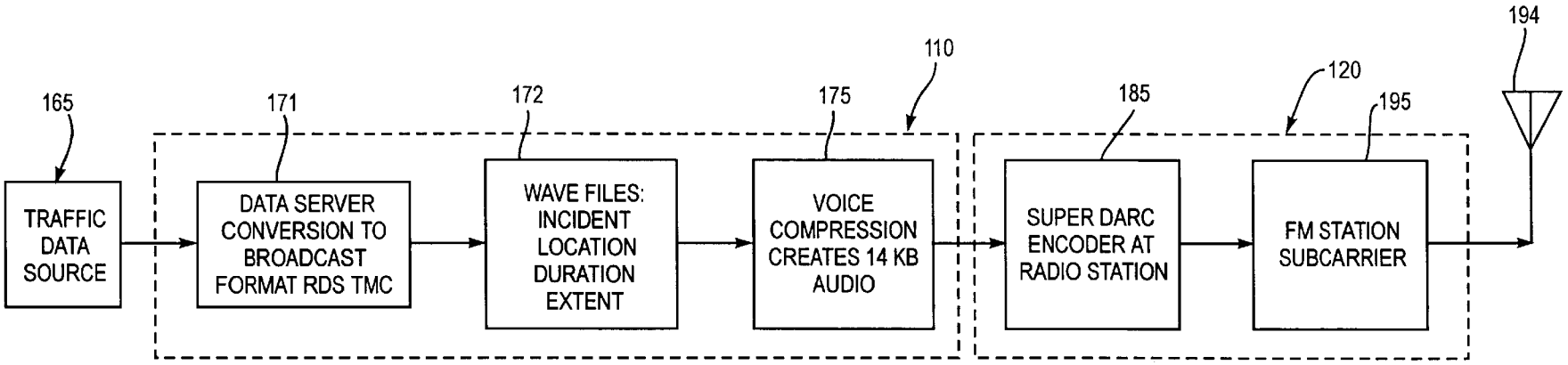
FIGS. 7A and 7B are an illustration of an alternative construction of the traffic paging system shown in FIG. 6.
Figure 7B:
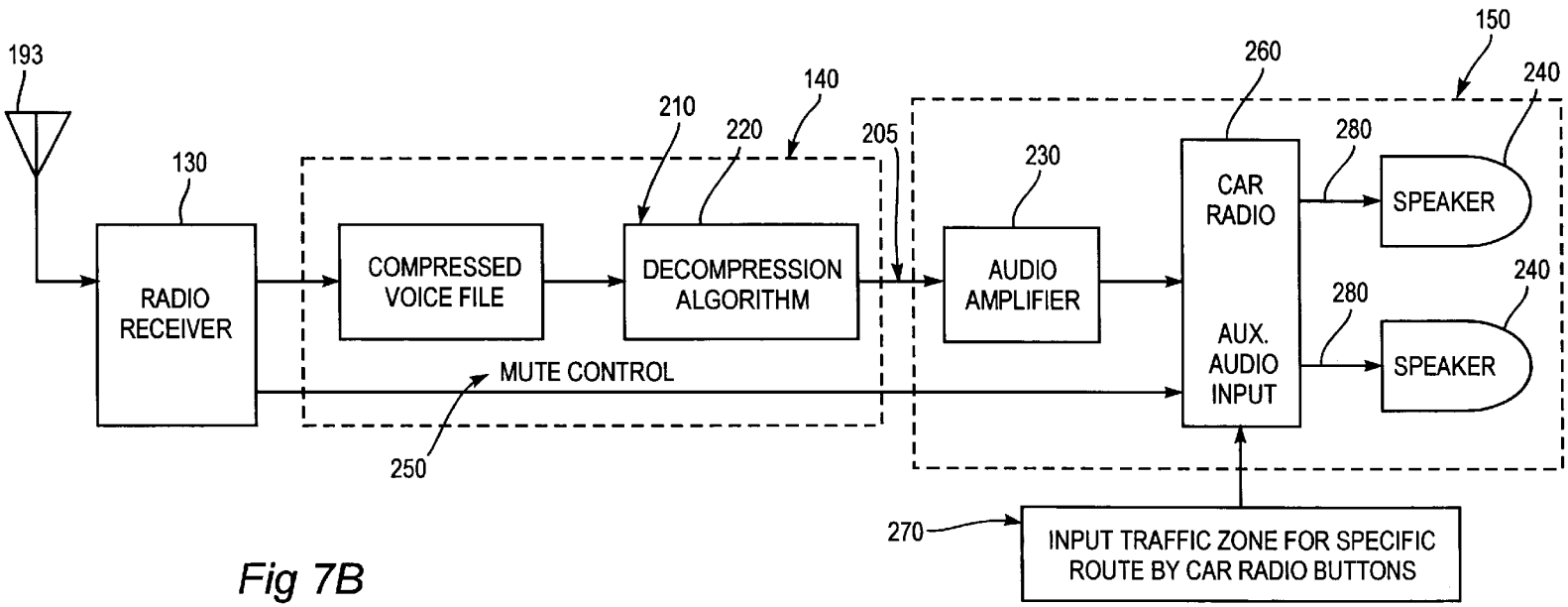

In a fourth preferred embodiment, the present invention may be implemented through the use of a radio transmission system 100 as shown in FIGS. 6, 7A, and 7B. As shown in FIG. 6, radio transmission system 100 comprises a converter 110, a radio transmitter 120, a radio receiver 130, a translator 140, and an audio system 150. The converter 110 preferably is capable of receiving audible speech information 160. The audible speech information 160 may be communicated to the converter 110 in any form including, for example, audibly and/or textually. Although preferably comprising live and/or real-time information, the audible speech information 160 may comprise any form of information, including recorded audible speech information such as prerecorded emergency instructions.

The audible speech information 160 includes information concerning incidents related to, for example, traffic, weather, news, and/or an emergency and/or preferably is received in a text format, such as ASCII and/or a RDS/TMC (Radio Data Systems/Traffic Message Channel) format, an international standard for distribution of traffic information. The audible speech information 160 in the RDS/TMC format includes an incident description and a location identifier. The incident descriptions may comprise an eleven-bit incident description and may include at least one of a set of incident descriptions as provided in a standard ITIS table. The set of incident descriptions may be substantially identical for all geographical locations. In contrast, the location identifier is sixteen-bits in length and includes at least one location identifier, each geographical location having a unique set of location identifiers. The audible speech information 160 also may include a duration and/or an extent of the incident and/or may be generated by the radio transmission system 100 and/or may be provided by a third-party Information Service Provider 165, such as ETAK, Inc., as shown in FIG. 7A.

Upon receipt, the audible speech information 160 is converted by the converter 110 into digital speech information 170, as shown in FIG. 6. The digital speech information 170 is in a broadcast format 171 and preferably has at least one electronic sound file 172 in any format, such as waveform sound or audio (.WAV) file. An electronic sound file may be provided for each of the set of incident descriptions and/or each of the set of location identifiers. Additional electronic sound files may be recorded for a plurality of durations and/or a plurality of extents for the incidents. By combining different combinations of electronic sound files, the characteristics of a wide variety of incidents may be described. The audible speech information 160 may be converted as a whole, or the audible speech information 160 may be separated into a plurality of segments comprising, for example, the description, location, duration identifier, and/or extent of the incident. Each electronic sound file preferably is recorded in advance. The converter 100 preferably includes a compressor 175. Once the audible speech information 160 has been converted into the digital speech information 170, the compressor 175 is adapted to compress the digital speech information 170. The compression preferably comprises voice compression and creates 14 KB audio. The compression algorithm preferably used is an algorithm entitled ESAC produced by Cybernetics InfoTech, Inc., Rockville, Md. The ESAC compression algorithm compresses both voice information and music, providing the advantages of a bit rate that applies to radio frequencies and that is adjustable depending on the application bandwidth.

As shown in FIG. 7A, the radio transmitter 120 preferably is coupled with, and capable of communicating with, the converter 110. The radio transmitter 120 is capable of receiving the digital speech information 170 from the converter 110 and/or to transmit the digital speech information 170 over a radio subcarrier 195 via a transmitting antenna 194. The radio transmitter 120 may include an encoder 185 that is adapted to encode the digital speech information 170. Although preferably comprising a FM subcarrier, the radio subcarrier 195 may comprise any broadcast frequency. The radio transmitter 120 may be a part of a subcarrier network and/or use a transmission scheme to transmit the digital speech information 170. The transmission scheme may comprise any form of transmission scheme, such as DARC or RDS, but preferably comprises a SuperDARC transmission scheme, due to its high net transmission rate. Very preferably, to transmit the digital speech information 170, the radio transmitter 120 includes a single chip subcarrier decoder integrated circuit, such as SkySpeed Part No. LFBGA 152+16.

Returning to FIG. 6, the radio transmitter 120 further may be capable of receiving other information from the converter 110, including analog information 180 and/or digital information 190, for transmitting. The analog information 180 comprises an analog signal and may include any type of audio information such as speech and/or music. The analog information 180 also may include free-form speech 185, which may be used, for example, to quickly broadcast emergency messages. Likewise, the converter 110 may communicate digital information 190, such as data signals, to the radio transmitter 120 for transmission and/or may include a multiplexer 200 for multiplexing the digital information 190 with the digital speech information 170. The digital information 190 may include any type of digital information, including e-mail and facsimile. Since the bandwidth of the radio transmitter 120 may be channelized, the transmission of different analog information 180 and/or different digital information 190 may be permitted.

As shown in FIG. 7B, the radio receiver 130 preferably is capable of radio communications with the radio transmitter 120 via a receiving antenna 193 and is adapted to receive the digital speech information 170. Upon receipt, the digital speech information 170 may be communicated to the translator 140. The translator 140 may include a decompressor 210 for decoding and/or decompressing the digital speech information 170 via, for example, a decompression algorithm 220. The decompressor 210 preferably substantially reverses the compression of the digital speech information 170 by the compressor 175. The translator 140 may be disposed within the radio receiver 130 and/or separate from the radio receiver 130. Once translated, the digital speech information 170 comprises voice information 205. The voice information 205 preferably is substantially similar to the audible speech information 160 and/or includes the electronic sound files included with the digital speech information 170. The radio receiver 130 also may support a preselected number of different information channels and/or services, including a preselected number of analog information channels and/or a preselected number of digital information channels. Thereby, the radio receiver 130 may receive the analog information 180 and/or the digital information 190 transmitted by the transmitter 120 via the receiving antenna 193.

The voice information 205 then is communicated to the audio system 150, which is coupled with, and capable of communicating with, the radio receiver 130 and/or the translator 140. Via the audio system 150, the voice information 205 may be audibly presented. For example, the electronic sound files may be converted to sound, which then may be amplified via, for example, an audio amplifier 230 and/or communicated to a speaker system 240. Preferably, the voice information 205 may be selectably audibly presented 270 through the use of the route-entry system 12, as described above and shown in FIG. 1. The route-entry system 12 may be used to specify one or more preselected routes 850, and the audio system 150 audibly presents only voice information 205 that is relevant to the one or more preselected routes 850. The audio system 150 also may include an internal calendar and/or clock (not shown) and may be programmed to audibly present relevant voice information 205 between a starting date and/or time and an ending date and/or time. Outside the starting date and/or time and the ending date and/or time, the audio system 150 is automatically muted 250.

The radio receiver 130, the translator 140, and audio system 150 can comprise a single unit. The single unit may be mobile like a handheld radio or pager. If the audio system 150 comprises a car radio 260, the radio receiver 130 and/or the translator 140 are coupled with the audio system 150 via a cellular telephone interface (not shown), and the voice information 250 is processed substantially as if a cellular telephone call was being passed through the car radio 260. For example, when the voice information 205 is received, a signal (not shown) from a radio receiver (not shown) in the car radio 260 is muted, permitting the voice information 205 to be audibly presented on the car radio's speakers 240.

As with the voice information 205, the radio receiver 130 may communicate the analog information 180 to the audio system 150. The analog information 180 may be communicated directly to the audio system 150 and/or indirectly via the translator 140. The audio system 150 may be adapted to audibly present the analog information 180 in the same manner as the voice information 205 is audibly presented, including the ability to mute the signal from the radio receiver of the car radio 260 when the analog information 180 is to be audibly presented.

While the invention is susceptible to various modifications and alternative forms, specific examples thereof have been shown by way of example in the drawings and are herein described in detail. It should be understood, however, that the invention is not to be limited to the particular forms or methods disclosed, but to the contrary, the invention is to cover all modifications, equivalents, and alternatives falling within the spirit and scope of the appended claims.

What is claimed is:

1. A traffic voice pager, comprising:

a route-entry system for specifying pager addresses associated with a preselected route;

a receiver system for receiving traffic voice pages, the receiver system being coupled with the route-entry system and including a message decoder for decoding pager addresses associated with the traffic voice pages and an address selector for selecting the traffic voice pages with the pager addresses that substantially correspond with the pager addresses associated with the preselected route;

an audio converter for converting the selected traffic voice pages into audio information, the audio converter being coupled with the address selector; and an audio system for audibly presenting the audio information, the audio system being coupled with the audio converter.

2. The traffic voice pager of claim 1, wherein said traffic voice pages comprise at least one predetermined code associated with an attribute of said traffic voice pages.

3. The traffic voice pager of claim 1, wherein said message decoder comprises a table associating a plurality of predetermined codes each with at least one attribute.

4. The traffic voice pager of claim 3, wherein said table comprises a plurality of prerecorded speech files.

5. The traffic voice pager of claim 4, wherein said plurality of prerecorded speech files each substantially comprise a human voice.

6. The traffic voice pager of claim 4, wherein said at least one of the plurality of prerecorded speech files comprises a compressed waveform audio file.

7. The traffic voice pager of claim 1, wherein said message decoder includes a speech generator for generating speech information from said traffic voice pages, said speech generator being coupled with said receiver system and said address selector.

8. The traffic voice pager of claim 7, wherein said speech generator comprises a speech synthesizer.

9. The traffic voice pager of claim 1, wherein said route-entry system comprises a plurality of switches and a map of a geographic region divided into a plurality of traffic zones, said preselected route being specified by selecting at least one of said plurality of traffic zones via said plurality of switches.

10. The traffic voice pager of claim 9, wherein said audio system substantially comprises a car radio and said plurality of switches substantially comprise a plurality of station preset buttons on said car radio.

11. The traffic voice pager of claim 10, wherein said receiver system is coupled with said car radio via a cellular telephone interface of said car radio such that, when at least one of said traffic voice pages substantially corresponds with said preselected route, said car radio mutes a radio receiver of said car radio and audibly presents said audio information.

12. A method for disseminating relevant, real-time traffic information, the method comprising the steps of:

specifying pager addresses associated with a preselected route;

receiving traffic voice pages;

decoding pager addresses associated with the traffic voice pages;

selecting the traffic voice pages with the pager addresses that substantially correspond with the pager addresses associated with the preselected route;

converting the selected traffic voice pages into audio information; and audibly presenting the audio information.

13. The method of claim 12, wherein the step of specifying comprises the steps of:

providing a map of a geographic region, said map being dividing into a plurality of traffic zones; and selecting at least one of said plurality of traffic zones to define said preselected route.

14. The method of claim 12, wherein the step of decoding comprises the steps of:

including at least one predetermined code with said traffic voice pages; and associating said at least one predetermined code with an attribute of said traffic voice pages.

15. The method of claim 12, wherein the step of decoding comprises the step of associating a plurality of predetermined codes for said traffic voice pages each with at least one attribute in a table.

16. The method of claim 15, wherein the step of associating includes the step of providing said table with plurality of prerecorded speech files.

17. The method of claim 16, wherein the step of providing comprises the step of prerecording said plurality of prerecorded speech files each substantially with a human voice.

18. The method of claim 16, wherein the step of providing comprises the step of storing said plurality of prerecorded speech files each as a compressed waveform audio file.

19. The method of claim 12, wherein the step of decoding occurs before the step of receiving.

20. The method of claim 12, wherein the step of receiving occurs before the step of decoding.

* * * * *